United States Patent [19]

LaDuke

[11] 4,272,145

[45] Jun. 9, 1981

[54] CONNECTOR LOCK RELEASE

[75] Inventor: Jack E. LaDuke, Livonia, Mich.

[73] Assignee: Ford Motor Company, Dearborn, Mich.

[21] Appl. No.: 87,193

[22] Filed: Oct. 22, 1979

[51] Int. Cl.[3] ..... H01R 13/627

[52] U.S. Cl. ..... 339/91 R

[58] Field of Search ..... 339/75 R, 75 M, 91 R

[56] References Cited

U.S. PATENT DOCUMENTS

| | | | |
|---|---|---|---|
| 3,178,674 | 4/1965 | Scheller | 339/91 R |
| 3,409,858 | 11/1968 | Krehbiel | 339/91 R |
| 3,417,365 | 12/1968 | Krehbiel | 339/91 R |
| 3,544,951 | 12/1970 | Roberts | 339/91 R |
| 3,611,261 | 10/1971 | Gregory | 339/91 R |
| 3,688,243 | 8/1972 | Yamada et al. | 339/91 R |
| 3,753,212 | 8/1973 | Yamada et al. | 339/91 R |
| 3,933,406 | 1/1976 | Cameron | 339/91 R |
| 4,010,998 | 3/1977 | Tolnar, Jr. et al. | 339/91 R |
| 4,026,624 | 5/1977 | Boag | 339/91 R |

*Primary Examiner*—John McQuade

*Attorney, Agent, or Firm*—Paul K. Godwin, Jr.; Peter Abolins; Clifford L. Sadler

[57] ABSTRACT

This specification discloses a locking structure for a pair of matable electrical connectors. The locking structure includes a latch assembly formed on one of the connectors and a mating ramp. The latch assembly includes integral locking and lever arms which coact with the ramp to permit locking and unlocking of the connectors. During locking of the connectors, the locking arm rides up the ramp member to insure proper mating of the connectors and then down a rear, vertical wall. During unlocking of the connectors, the lever arm uses the ramp as fulcrum to raise the locking arm clear of the rear wall permitting movement of the locking arm over the ramp so that the connectors are easily unmated. The lever arm and the latch arm are connected at only one end thereby forming an elongated, generally V-shaped opening. This entrance is partially closed by a projecting guard so that wires cannot enter between the lever arm and the locking arm and get stuck.

6 Claims, 5 Drawing Figures

CONNECTOR LOCK RELEASE

BACKGROUND OF THE INVENTION (1) Field of the Invention

This invention relates generally to matable electrical connectors and, more specifically, to matable electrical connector bodies having locks for retaining the connector bodies in a mated position.

(2) Prior Art

Various locking devices for securing two electrical connectors together are known. However, it has been difficult to solve the apparently conflicting requirements of providing an easy connection and an easy disconnection while maintaining a secure connection before disconnection occurs. For example, U.S. Pat. No. 3,933,406 issued Jan. 20, 1976 for an "Electrical Connector Block Assembly Having Overcenter Locking" teaches a locking finger which rides over a ramp. This patent is assigned to the assignee of this patent application and is hereby incorporated by reference. The patent contains an informative discussion of the requirements associated with mating of electrical connectors, particularly those electrical connectors which are utilized in automotive vehicles. The discussion includes a description of the prior art and shows a particular system for overcoming the disadvantages noted in the prior art. There is also a full discussion of the requirements for securing proper mating of electrical connections and the desirability of providing an electrical connector which gives all the desired mating characteristics but also permits easy unmating of such connectors when separation of the connectors is desired.

However, the locking mechanism disclosed by this patent includes a rearwardly projecting portion which can snag a wire. Snagging is a relatively common problem with connectors and is undesirable because it may interfere with disconnection or damage electrical wiring. These are some of the problems this invention overcomes.

SUMMARY OF THE INVENTION

This invention provides a lock feature with a configuration which reduces snagging. The lock feature of a first connector includes a locking finger coacting with a ramp on a second connector. The ramp acts as a fulcrum for a lever arm attached to the locking finger.

An embodiment of this invention provides a relatively simple to manufacture and simple to use connection. The connection is both easy to lock and easy to unlock and yet remains locked when electrical mating between two connectors is desired.

DETAILED DESCRIPTION OF THE PREFERRED EMBODIMENT

Figure 1:
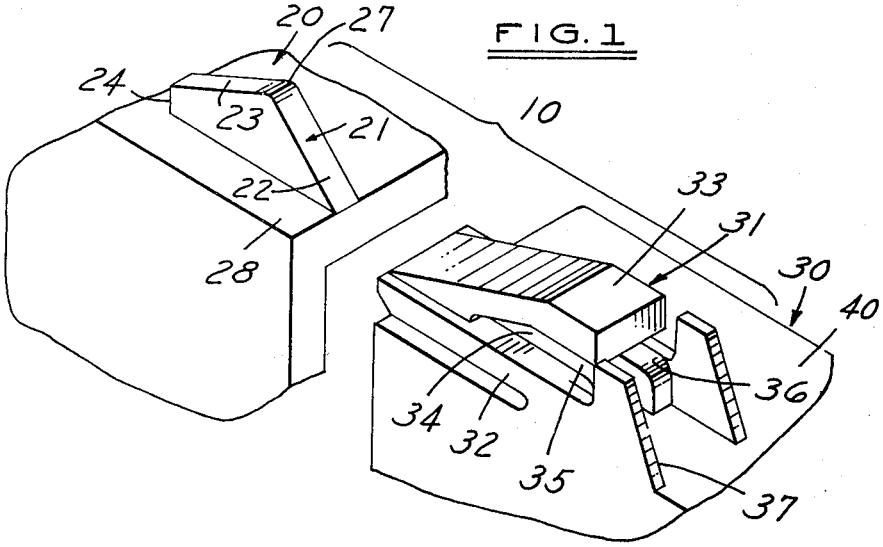
FIG. 1 is a partial perspective view of a connector assembly in accordance with an embodiment of this invention including a mating ramp and latch assembly.
Figure 2:
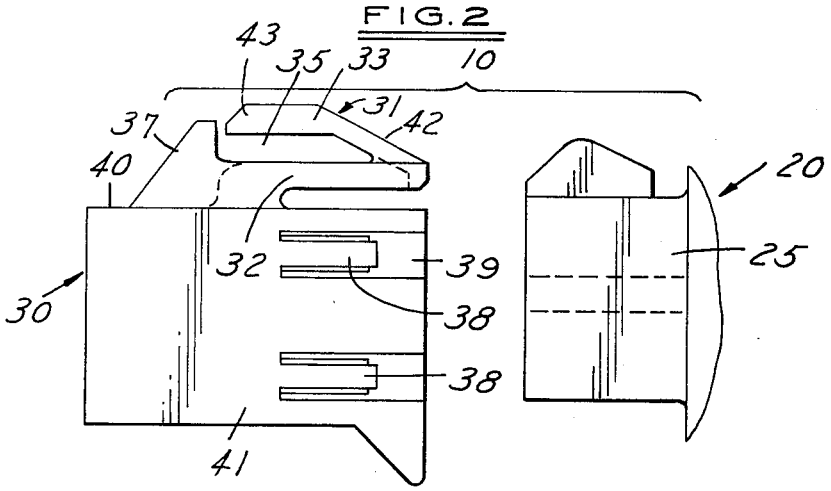
FIG. 2 is a side elevation view of a connector assembly in accordance with an embodiment of this invention wherein the two electrical connectors are in an unmated position.
Figure 3:
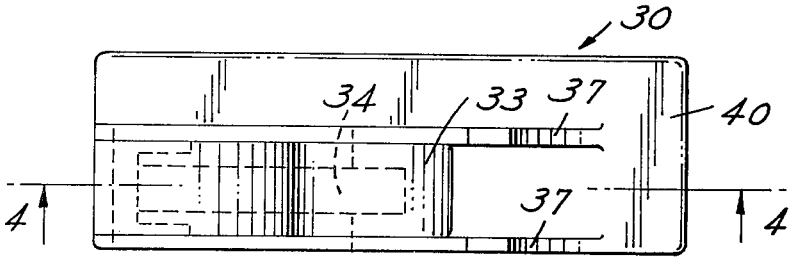
FIG. 3 is a top plan view taken along line 3—3 of FIG. 4.

Referring to FIGS. 1 and 2, connector assembly 10 includes an electrical connector 20 with a mating ramp 21 for engaging a latch assembly 31 of an electrical connector 30. Latch assembly 31 includes a locking arm 32 with a slot 34 which rides over mating ramp 21. To disengage latch assembly 31 from mating ramp 21, a lever arm 33, connected to locking arm 32, is tilted about the peak of mating ramp 21 thereby raising locking arm 32 and freeing mating ramp 21 from slot 34.

Electrical connectors 20 and 30 are generally rectangular solids. Electrical connector 20 has a top surface 28 for supporting mating ramp 21. Electrical connector 30 has a top surface 40 for supporting latch assembly 31. Latch assembly 31 is aligned on top surface 40 so that when electrical connectors 20 and 30 are mated, slot 34 of locking arm 32 is aligned with the forward incline surface 22 of mating ramp 21. Locking arm 32 is generally U-shaped with the two ends of the arms connected to top surface 40 and the bottom of the U portion cantilevered out and extending toward mating ramp 21.

Electrical connectors 20 and 30 each include elongated terminal receiving cavities 25 and 39, respectively, for retaining conductive terminals which contact one another when electrical connectors 20 and 30 are mated. Typically, a male blade terminal is positioned in receiving cavity 25 and a female terminal is positioned in receiving cavity 39 (terminals not shown). Electrical connector 30 has a side surface 41 for supporting a pair of retaining fingers 38. Fingers 38 engage openings in the female terminal thus locking the female terminal in electrical connector 30.

An electrical lead carries wiring structure (not shown) to the terminals within the electrical connectors. The type and shape of the electrical terminals housed within the two connectors is a matter of choice to the designer. Any of many different types of terminals and connectors may be utilized with the structure of this particular invention which provides an easily releasable lever locking structure with resistance to wire snagging.

Mating ramp 21 includes a forward inclined surface 22 which adjoins a rear inclined surface 23 at a fulcrum 27. A rear vertical wall 24 starts on the end of rear inclined surface 23 away from fulcrum 27. Wall 24 serves to keep locking arm 32 from sliding up rear inclined surface 23 when connector assembly 10 is locked.

Figure 4:
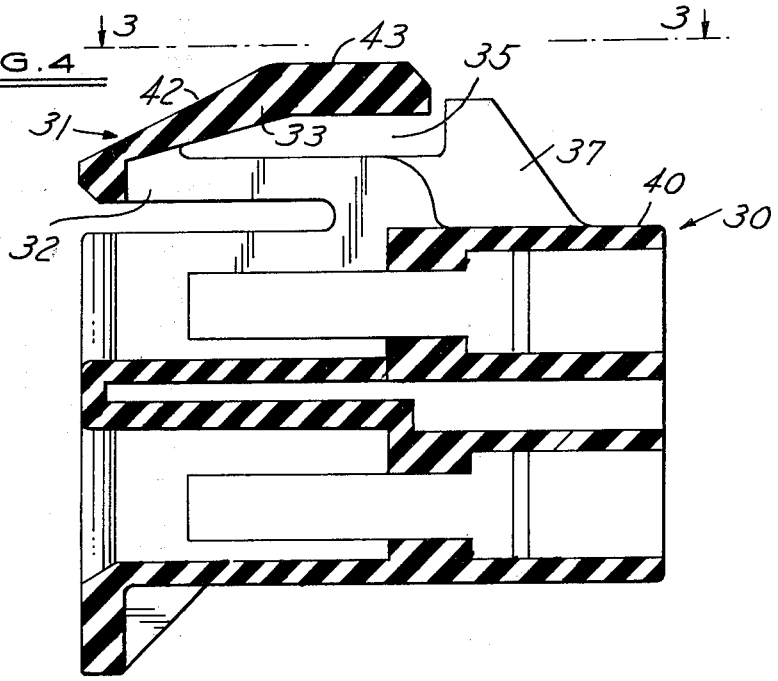
FIG. 4 is a sectional view taken along section line 4—4 of FIG. 3.

Lever arm 33 is an elongated member with one end connected to the U-shaped bottom portion of locking arm 32. Thus, in side elevation, a V-shaped opening 35 (FIGS. 2 and 4) is formed. Lever arm 33 has an inclined portion 42 extending from the connection with locking arm 32 up to a flat portion 43 which extends generally parallel to locking arm 32. A pair of guard plates 37 extend up from top surface 40 adjacent locking arm 32 up to at least the bottom of lever arm 33. Facing in the same direction as the mouth of V-shaped opening 35, guard plates 37 have an inclined edge which guides any wire away from V-shaped opening 35 and over lever arm 33. Connector assembly 10 is typically used in an environment with many loose wires. Such wires could get tangled in the V-shaped opening 35 and cause undesirable breakage or snagging of the wires.

OPERATION

Referring to FIGS. 1 and 2, slot 34 of locking arm 32 is aligned with mating ramp 21 so that when electrical connector 20 is mated to electrical connector 30 latch assembly 31 is positively coupled to mating ramp 21. More specifically, as connectors 20 and 30 are pushed toward one another, the bottom U-shaped portion of locking arm 32 engages forward inclined surface 22 and rides up to fulcrum 27. The energy stored as locking arm 32 moves up the ramp 21 is dissipated on rear inclined surface 23. This action draws the two connectors together until locking arm 32 engages rear wall 24. When mating ramp 21 is positioned in slot 34, the bottom of the U of locking arm 32 is positioned against rear wall 24 and is securely held there. That is, any force tending to pull connectors 20 and 30 apart is resisted by the force of rear wall 24 against the bottom of the U of locking arm 32.

Figure 5:
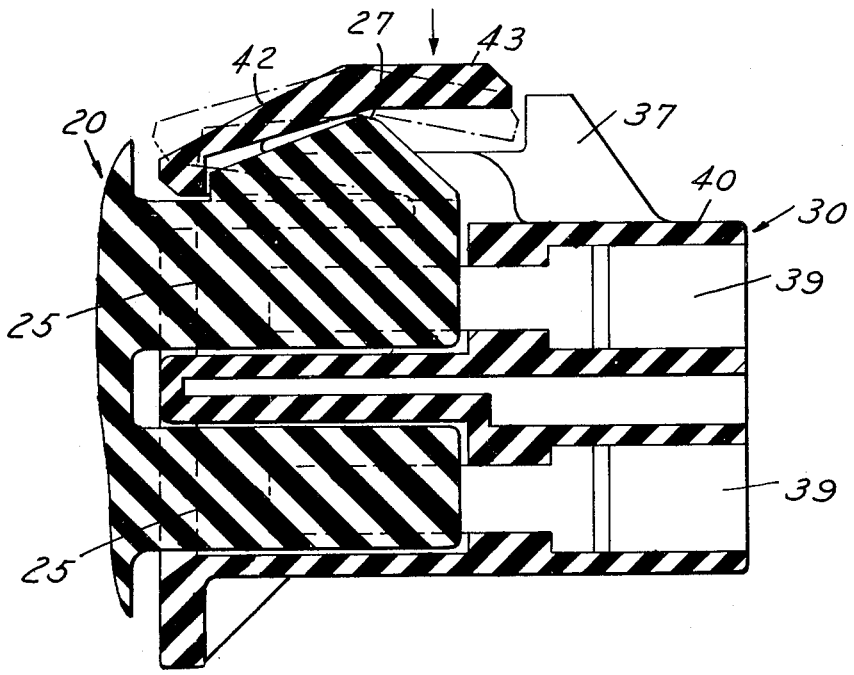
FIG. 5 is a section view similar to FIG. 4 but includes both of the electrical connectors of the connector assembly and shows a deflected and undeflected position of the latch assembly.

Referring to FIG. 5, when disconnecting connector 20 from connector 30, lever arm 33 is depressed. A force (indicated by an arrow) applied to flat portion 43 causes the bottom of lever arm 33 to engage fulcrum 27 and pivot as indicated in FIG. 5. When lever arm 33 pivots, the attached U portion of locking arm 32 is raised sufficiently above the top of rear wall 24 so that pulling connectors 20 and 30 apart causes locking arm 32 to ride up rear inclined surface 23, over fulcrum 27 and down forward inclined surface 22. When electrical connectors 20 and 30 are pulled apart, the electrical terminals within terminal receiving cavities 25 and 39 are disconnected. Locking arm 32 is cantilevered from its connection to top surface 40 and lever arm 33 is cantilevered back from its connection to locking arm 32.

Various modifications and variations will no doubt occur to those skilled in the various art to which this invention pertains. For example, the particular angle of the ramps may be varied from that disclosed herein. Advantageously, locking arm 32 extends generally linearly, without a pronounced bend, away from lever arm 33. These and all other variations which basically rely on the teachings through which this disclosure has advanced the art are properly considered within the scope of this invention.

I claim:

1. Matable electrical connector means having lock means comprising:

a first connector body of molded insulating material having at least one first longitudinal open ended terminal receiving cavity having a first terminal retained therein having a forward female portion;

a second connector body of molded insulating material having at least one second longitudinal open ended terminal receiving cavity having a second terminal retained therein having a forward male portion;

one of said first and second connector bodies having an integral cantilevered latch arm means and the other of said first and second connector bodies having protruding generally triangular locking ramp means which cooperate to lock said connector body in said mated position;

said latch arm means including a first leg projecting forward and a second, integral leg extending backward from the forwardmost portion of said first leg thus generally forming a V-shape, said forwardmost portion of said first leg engaging said ramp means and being deflected outwardly during mating, said second leg being capable of coacting with said ramp means as a lever and a fulcrum to assist in raising said first leg to release said lock means; and guard means extending from a main portion of the connector body having said latch arm means toward the free rearwardmost end of said second leg thereby acting to shield said V-shaped opening between said first and said second legs and preventing wires from being snagged in the opening between said first and second legs.

2. A matable electrical connector means as recited in claim 1 wherein said second leg extends generally at an acute angle with respect to said first leg.

3. A matable electrical connector means as recited in claim 2 wherein said guard means are a pair of parallel, spaced protrusions each having sloping rearward facing surfaces which extend at least up to the bottommost portion of said second leg adjacent said first leg so as to prevent wire snagging between said first and second legs.

4. A matable electrical connector means as recited in claim 3 wherein said ramp means includes a vertical rear wall to coact with said first leg to provide a locking action and said ramp means includes a high point to serve as a fulcrum for a force to lift said first leg of said latch arm means above the vertical wall of said ramp means thereby releasing the lock and allowing disengagement of said first and second connector bodies.

5. A matable electrical connector means as recited in claim 4 wherein said ramp means includes a rising forwardmost face and a declining intermediate face between said forwardmost face and said rear vertical wall so that said first leg rides up said forwardmost face and rides down said intermediate face, there being a peak between said intermediate and forwardmost faces which acts as a fulcrum when abuting said second leg and is positioned intermediate the extremities of said second leg.

6. A matable electrical connector means as recited in claim 5 wherein each of said protrusions of said guard means is generally planar and extends along side a portion of the outside of said first leg to a position to the rear of said first leg, said protrusions each being topped by a flat surface adjacent said sloping rearward facing surfaces.

* * * * *